US010807113B2

(12) United States Patent
Santagiuliana

(10) Patent No.: US 10,807,113 B2
(45) Date of Patent: Oct. 20, 2020

(54) DEVICE FOR DISPENSING FLUIDS OR MIXTURES

(71) Applicant: TAPLAST s.r.l., Dueville (VI)—Fraz. Povolaro (IT)

(72) Inventor: Evans Santagiuliana, Vicenza (IT)

(73) Assignee: TAPLAST S.R.L. (IT)

( * ) Notice: Subject to any disclaimer, the term of this patent is extended or adjusted under 35 U.S.C. 154(b) by 0 days.

(21) Appl. No.: 16/066,039

(22) PCT Filed: Dec. 19, 2016

(86) PCT No.: PCT/IB2016/057763
§ 371 (c)(1),
(2) Date: Jun. 25, 2018

(87) PCT Pub. No.: WO2017/109664
PCT Pub. Date: Jun. 29, 2017

(65) Prior Publication Data

US 2019/0009292 A1 Jan. 10, 2019

(30) Foreign Application Priority Data

Dec. 23, 2015 (IT) ..... 102015000087493

(51) Int. Cl.
*B05B 11/00* (2006.01)

(52) U.S. Cl.
CPC ..... *B05B 11/3032* (2013.01); *B05B 11/007* (2013.01); *B05B 11/0027* (2013.01); *B05B 11/0044* (2018.08); *B05B 11/3067* (2013.01)

(58) Field of Classification Search
CPC ..... B05B 11/3032; B05B 11/0044; B05B 11/0027; B05B 11/007; B05B 11/3067
USPC ..... 222/190, 207, 383.1, 153.13–153.14; 239/330, 333
See application file for complete search history.

(56) References Cited

U.S. PATENT DOCUMENTS 2,868,586 A * 1/1959 Croce ..... B05B 11/06 239/362
3,489,322 A * 1/1970 Ayres ..... B05B 1/3436 222/341
4,336,895 A * 6/1982 Aleff ..... B05B 11/3028 222/207
5,492,252 A * 2/1996 Gueret ..... B05B 11/0029 222/207
5,636,768 A * 6/1997 Yamada ..... B05B 11/0032 222/383.1
5,664,703 A * 9/1997 Reifenberger ..... B05B 11/0064 222/207

(Continued)

*Primary Examiner* — Paul R Durand
*Assistant Examiner* — Andrew P Bainbridge
(74) *Attorney, Agent, or Firm* — McDonald Hopkins LLC

(57) ABSTRACT

The invention concerns a device (1) for dispensing a fluid (L), comprising a supporting structure (2) provided with means (3) for coupling it with a container (C) holding the fluid (L) and comprising: an outlet duct (63) for the fluid (L); a collapsible chamber (60); first valve means (25) suited to control the passage of the fluid; air refilling valve means. The air refilling valve means comprise a flexible portion (15) of an edge (14) belonging to a first element (10) of the device (1), suited to assume a closed position and an open position. The invention concerns also a system comprising a container and a device made as described above.

13 Claims, 12 Drawing Sheets

(56) References Cited

U.S. PATENT DOCUMENTS

| | | | | | |
|---|---|---|---|---|---|
| 5,709,325 | A * | 1/1998 | Renault | B05B 11/0044 | 222/383.1 |
| 5,829,640 | A * | 11/1998 | Hershey | B05B 11/3032 | 222/153.13 |
| 6,378,739 | B1 * | 4/2002 | Maas | B05B 11/0005 | 222/383.1 |
| 6,796,343 | B2 * | 9/2004 | Kelsey | B67D 7/344 | 141/354 |
| 7,793,866 | B2 * | 9/2010 | Chou | B05B 11/0029 | 239/354 |
| 7,891,526 | B2 * | 2/2011 | Schliemann | B05B 11/0029 | 222/321.7 |
| 9,833,800 | B2 * | 12/2017 | Ray | F04B 9/14 | |
| 2009/0008415 | A1 * | 1/2009 | Ohshima | B05B 11/0067 | 222/383.1 |
| 2012/0091229 | A1 * | 4/2012 | Laidler | B05B 7/0037 | 239/330 |
| 2016/0073833 | A1 * | 3/2016 | Ciavarella | A47K 5/14 | 222/190 |

* cited by examiner

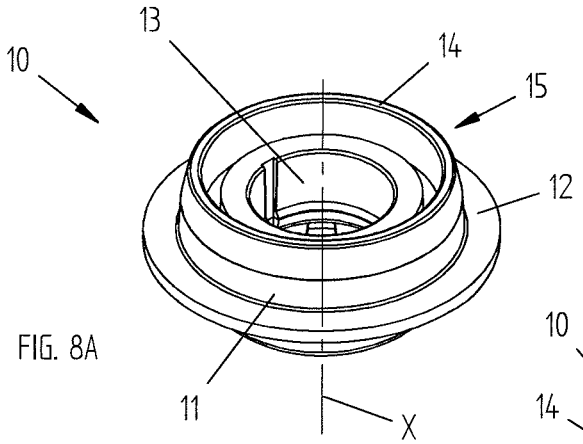
FIG. 8A
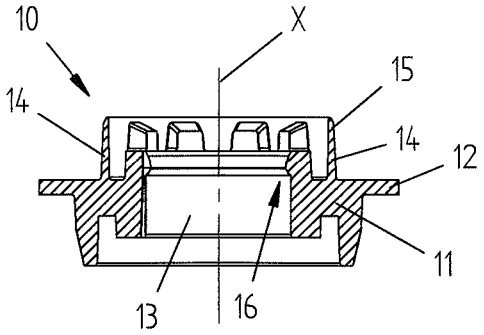
FIG. 8B
FIG. 9A
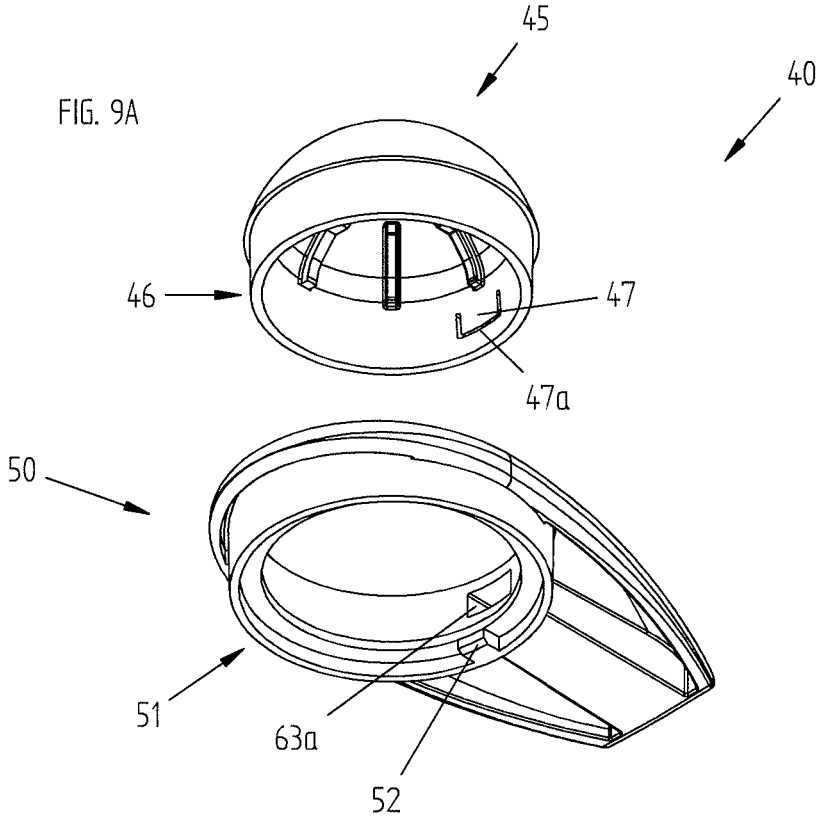

DEVICE FOR DISPENSING FLUIDS OR MIXTURES

CROSS-REFERENCE TO RELATED APPLICATIONS

This is the U.S. national phase of international patent application no. PCT/IB2016/057763 filed on Dec. 19, 2016, which claims priority based on Italian patent application no. 102015000087493 filed on Dec. 23, 2015.

TECHNICAL FIELD OF THE INVENTION

The present invention concerns the technical field of systems for dispensing fluids or mixtures.

In particular, the present invention concerns a device for dispensing a fluid, which is suited to be applied to a container holding the fluid itself, particularly suited to dispense food substances, perfumes or detergents in general.

DESCRIPTION OF THE STATE OF THE ART

It is known that dispensing devices are used in the field of systems for dispensing liquid or creamy products, such as food substances, soaps, creams, detergents or perfumes, wherein said dispensing devices are provided with a collapsible chamber and are applied to the container holding said products.

Said devices are substantially constituted by a supporting structure provided with means for coupling the device with the neck of the container, and with a dispensing unit for the fluid held in the container, constituted by a collapsible chamber suited to suck and contain a dose of the fluid coming from the container and to dispense said dose.

The fluid is sucked into the collapsible chamber and dispensed through manual operation by the user, who first directly compresses and then releases the collapsible chamber by acting thereon with one or more fingers. During the compression step, the fluid contained inside the collapsible chamber is dispensed towards the external environment through a suitable outlet duct. In the successive release step, the collapsible chamber automatically returns to the non-compressed position, sucking a dose of fluid through a thin tube that sucks it from the inside of the container and conveys it into the chamber itself, and said dose will remain therein, ready for the successive dispensing step.

For this purpose, the dispensing device is provided with first valve means that allow or prevent the flow of the fluid from the inside of the container towards the chamber, said valve means being typically constituted by a ball that opens/closes the terminal portion of the thin tube introduced in the chamber.

Always during the release step, the inside of the container is refilled with a given quantity of air, in order to prevent the container from remaining partially squeezed.

For this purpose, the dispensing device is furthermore provided with an air refilling system which is equipped with respective further valve means and makes it possible to suck the required quantity of air from the outside, so as to compensate for the volume of the dispensed fluid and maintain the normal shape of the container. This step is also known as venting step.

Also said known valve means are constituted by a ball which opens/closes a duct conveniently obtained between the elements that make up the dispensing device.

The dispensing devices belonging to the state of the art, however, pose some drawbacks.

A first drawback posed by said dispensing devices is constituted by their construction complexity.

Another drawback posed by said devices is constituted by their high production costs and/or times.

A further drawback posed by said devices, deriving from said complex construction, is constituted by the reduced reliability and duration of the elements that make them up.

The object of the present invention is to overcome all the drawbacks described above.

In particular, it is an object of the present invention to provide a solution that makes it possible to simplify the construction of the dispensing device.

It is another object of the present invention to propose a solution that makes it possible to reduce the production times and/or costs of said dispensing devices.

It is another object of the present invention to propose a dispensing device which is more reliable and more efficient than the devices of the known type.

It is a further object of the present invention to provide a dispensing device that is characterized by reduced overall dimensions and weight compared to the devices of the known type.

SUMMARY OF THE PRESENT INVENTION

The present invention is based on the general consideration that it is possible to provide a device for dispensing a fluid for a container holding said fluid, said device being provided with air refilling valve means suited to control the passage of a given quantity of air from the outside of said container towards the inside of said container, wherein said air refilling valve means comprise at least one flexible portion of an edge suited to assume a closed position and an open position in order to prevent or allow the passage of said quantity of air from the outside of the container towards the inside of the container.

According to a first aspect of the present invention, the subject of the same is therefore a device for dispensing a fluid, comprising a supporting structure provided with means for coupling it with a container which holds said fluid and comprises:

an outlet duct for said fluid;

at least one collapsible chamber suited to receive a given quantity of said fluid;

first valve means suited to control the passage of said fluid from the inside of said container towards said chamber;

air refilling valve means suited to control the passage of a given quantity of air from the outside of said container towards the inside of said container, wherein said air refilling valve means comprise at least one flexible portion of an edge belonging to a first element of said device associated with said supporting structure, said flexible portion being suited to assume a closed position intended to avoid the passage of air from the outside of said container towards the inside of said container and suited to assume an open position intended to allow the passage of said quantity of air from the outside of said container towards the inside of said container.

According to a preferred embodiment of the invention, the device comprises a second element associated with the first element, said second element comprising a counteracting element suited to push the flexible portion in such a way as to move the flexible portion from the closed position to the open position.

In a preferred embodiment, the second element comprises a surface suited to allow the edge to completely abut it in the closed position.

Preferably, the counteracting element is suited to assume a first rest position, in which it does not act against the flexible portion in the closed position, and an operating position, in which it pushes the flexible portion, moving it to the open position.

According to a preferred embodiment of the invention, the device comprises a third element associated with the second element, said third element comprising a reference element suited to cooperate with the counteracting element so as to move the latter between the first rest position and the operating position.

In a preferred embodiment, the third element can be moved with respect to the second element, in such a way that it can be placed in a first position, in which the reference element does not cooperate with the counteracting element, and in a second position, in which the reference element cooperates with the counteracting element so as to move it to the operating position.

Preferably, the third element can be rotated with respect to the second element between the first position and the second position.

According to a preferred embodiment of the invention, the edge is an annular edge that develops around a main axis.

According to a preferred embodiment, the chamber is at least partially defined by an elastically yielding portion associated with the supporting structure.

Preferably, the chamber is at least partially defined by an elastically yielding portion of the third element.

Preferably, the elastically yielding portion has a substantially hemispherical shape.

According to a preferred embodiment of the invention, the outlet duct is obtained in the third element.

In a preferred embodiment, the device comprises second valve means suited to control the passage of the fluid from the chamber towards the outlet duct.

In a first preferred embodiment, the second valve means comprise a movable element belonging to the third element.

Preferably, the device comprises a thin suction tube suited to convey the fluid from the container to the chamber.

According to a preferred embodiment of the invention, the first valve means comprise a ball.

The coupling means conveniently allow the device to be removably coupled with the container.

According to a second aspect of the present invention, the subject of the latter is a system for dispensing a fluid, comprising a container for said fluid and a device for dispensing said fluid, wherein said device is made according to the description provided above.

BRIEF DESCRIPTION OF THE DRAWINGS

Further advantages, objects and characteristics, as well as further embodiments of the present invention, are defined in the claims and will be illustrated in the following description, with reference to the enclosed drawings; in the drawings, corresponding or equivalent characteristics and/or components of the present invention are identified by the same reference numbers. In particular, in the drawings:

FIG. 8A shows an axonometric view of an element of FIG. 5;

FIG. 8B shows a sectional view of the element of FIG. 8A;

FIG. 9A shows an exploded axonometric view of an element of FIG. 5;

DETAILED DESCRIPTION OF THE PRESENT INVENTION

The example of embodiment of the invention described here below concerns a device for dispensing a product preferably constituted by a detergent. It is clear that the proposed solution can be applied also to devices for dispensing perfumes or food products, or any other fluid in general, collected from a container and conveyed towards the outside.

Figure 1:
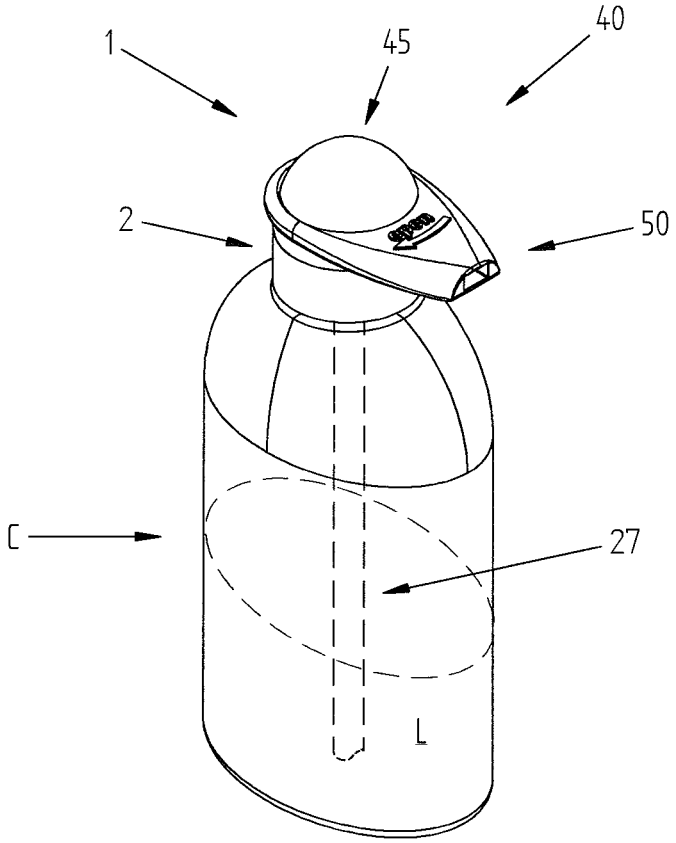
FIG. 1 shows a first embodiment of the dispensing device of the invention applied to a container in a first locked configuration.

An example of embodiment of a device 1 for dispensing fluids, which is the subject of the present invention, is shown in FIG. 1, where it is represented applied to a container C holding a fluid L to be dispensed.

Figure 2:
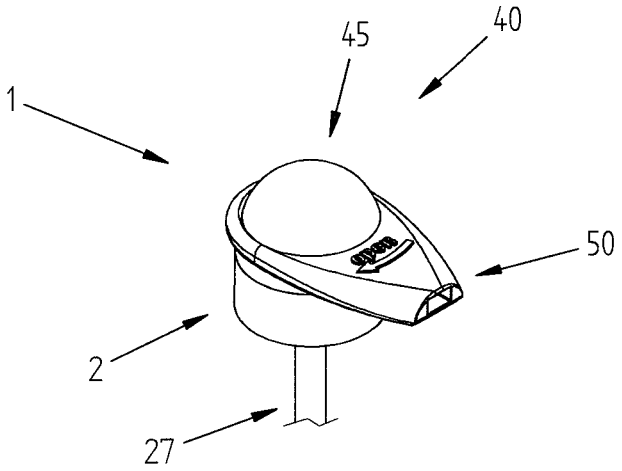
FIG. 2 shows an axonometric view of the device of the invention shown in FIG. 1.

In FIG. 2 the device 1 is represented separate from the container C.

Figure 6:
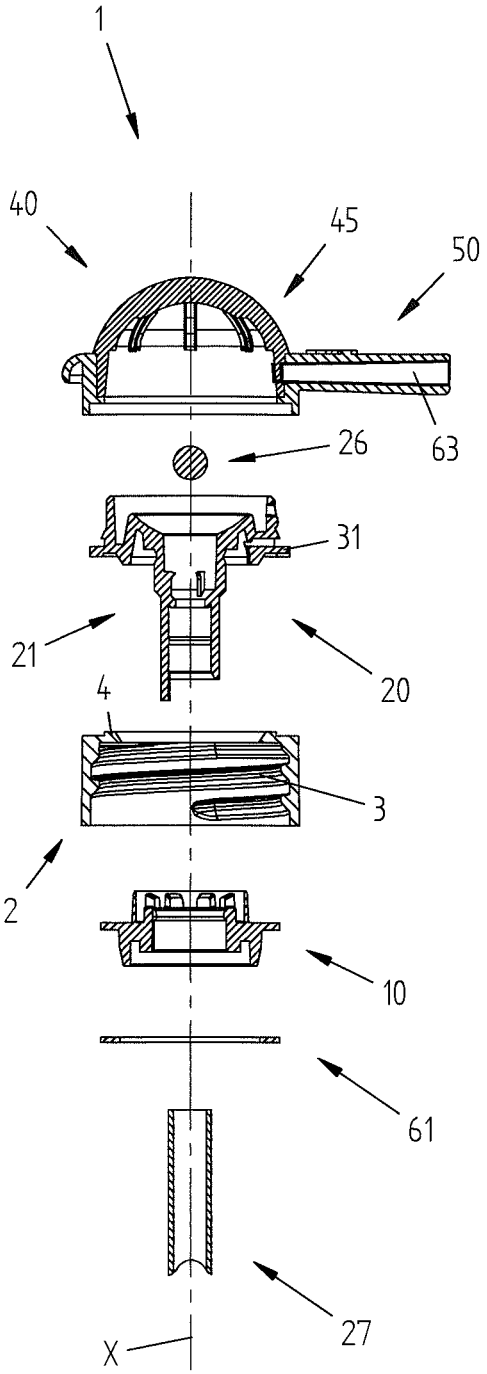
FIG. 6 shows a sectional view of FIG. 5.

The dispensing device 1 comprises a supporting element 2 provided with means 3 for coupling it with the container C. Said coupling means 3 are constituted by a threaded portion, visible in FIGS. 6 and 14B, suited to become engaged with a corresponding threaded portion Cf present on the neck of the container C, visible in FIG. 14B.

In variant embodiments, said coupling means may be of a different type, for example of the snap-on type.

The supporting element 2 has a preferably cylindrical shape in which it is possible to identify, in an inner area facing towards the container C, said threaded portion 3. The supporting element 2 furthermore comprises an upper annular edge 4 (better visible in FIG. 14B).

The supporting element 2 is associated with a first lower element 10, a second intermediate element 20 and a third upper element 40. A sealing gasket 61 is preferably interposed between the lower element 10 and the neck of the container C.

The upper element 40 can be rotated with respect to the intermediate element 20 between two operating positions, corresponding to two configurations of the dispensing device 1 when the latter is associated with the container C.

In the embodiment illustrated herein, the upper element 40 can be rotated by 90° between the two operating positions. In variant embodiments, said angle may be different, but in any case it will be such as to define at least two distinct operating positions.

Figure 3:
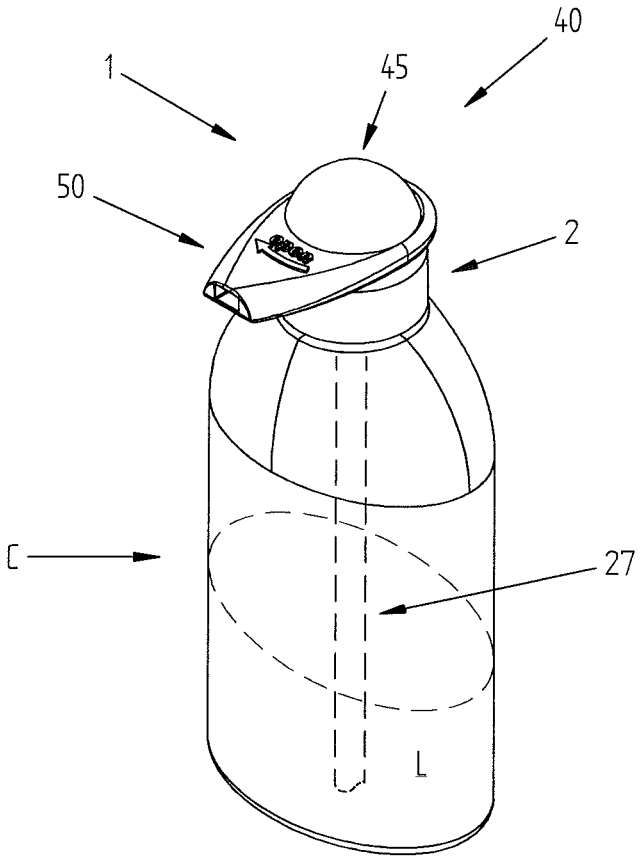
FIG. 3 shows the dispensing device of FIG. 1 applied to the container in the dispensing configuration.
Figure 4:
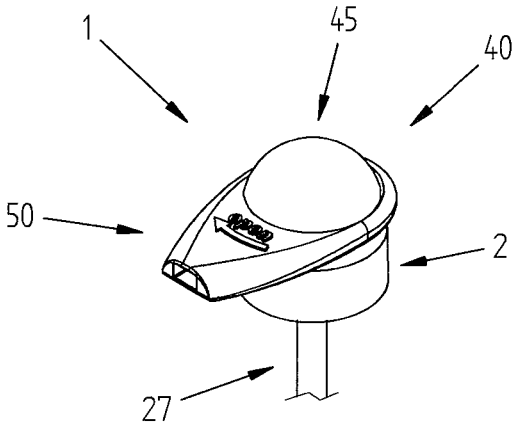
FIG. 4 shows an axonometric view of the dispensing device of FIG. 3 in the dispensing configuration.
Figure 5:
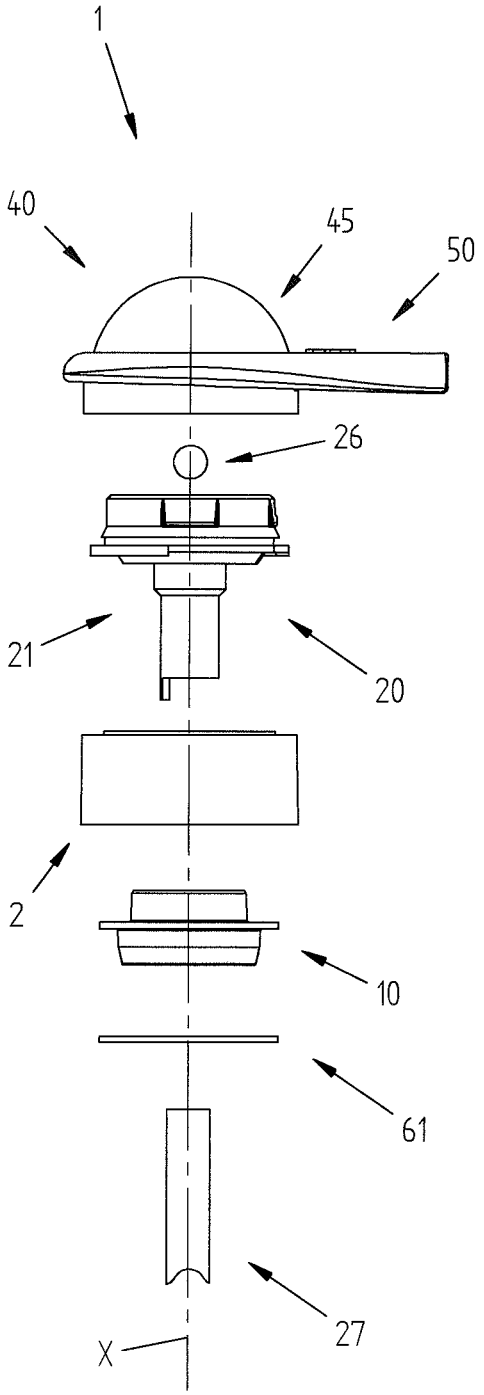
FIG. 5 shows an exploded side view of the dispensing device of the invention shown in FIG. 2.

In particular, it is possible to identify a locked configuration of the dispensing device 1, in which the fluid L cannot be dispensed from the container C, for example as shown in FIG. 1, and a configuration of use, in which the fluid L can be dispensed from the container C, for example as shown in FIG. 3.

The lower element 10, visible in FIGS. 8A and 8B, is preferably provided with a main body 11 whose cross section develops according to a preferably circular shape around a main axis X. The lower element 10 comprises a first edge 12 that extends externally from the main body in the direction away from the main axis X.

Figure 14B:
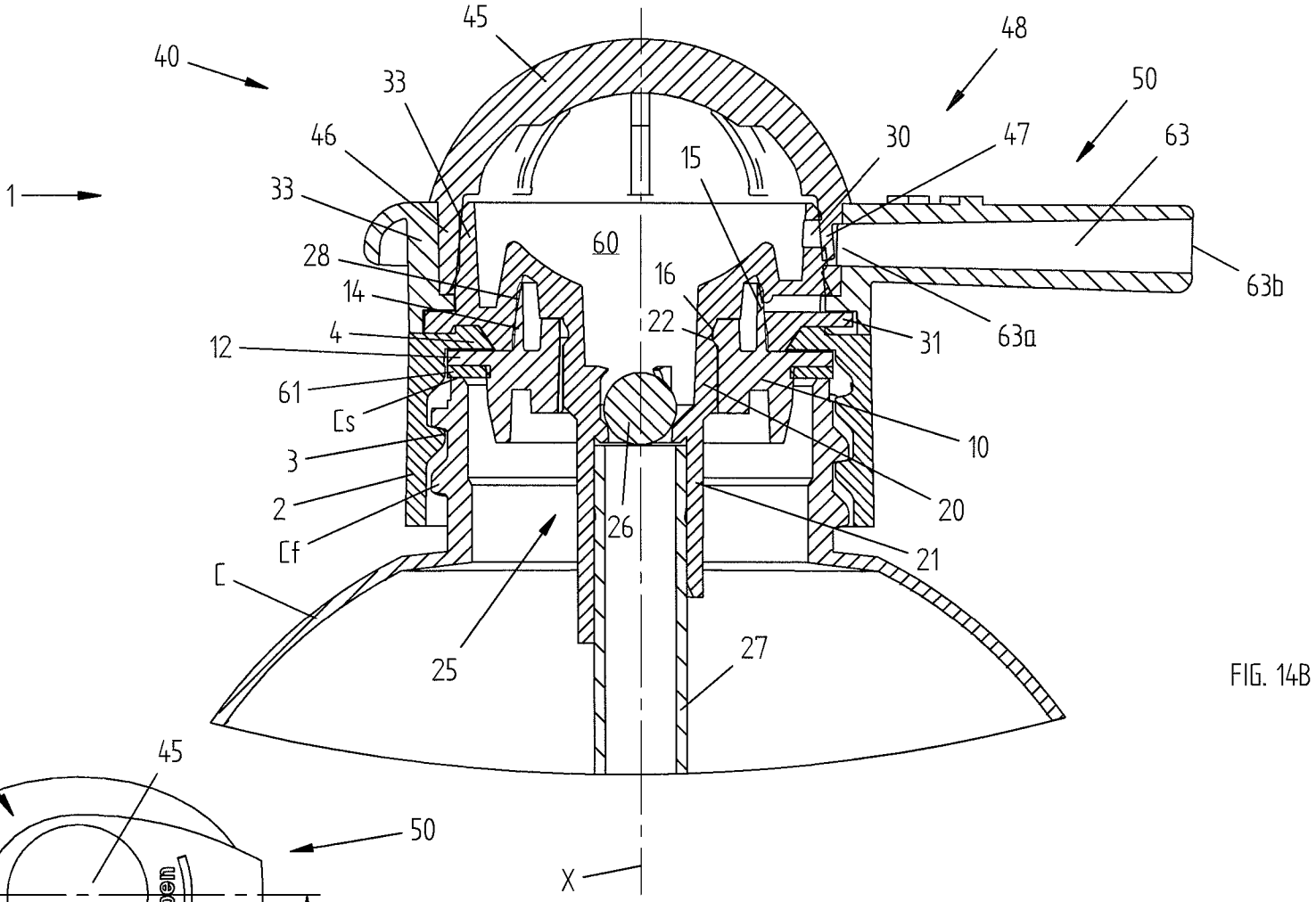
FIG. 14B shows the partial sectional view according to line XIV-XIV of FIG. 14A.
Figure 14A:
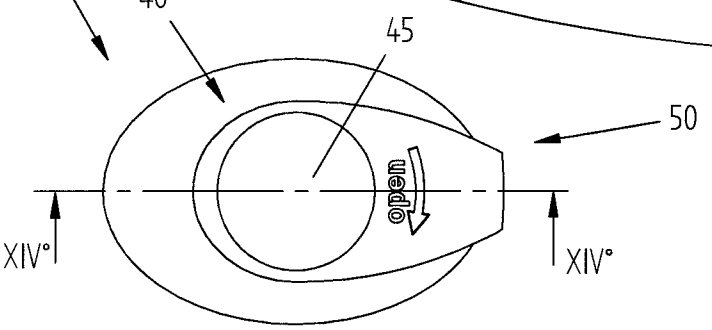
FIG. 14A shows a top plan view of the system of FIG. 1 in the first locked configuration.

When the supporting element 2 is coupled with the neck of the container C, preferably through a screwing operation in the embodiment illustrated and described herein, the first edge 12 of the lower element 10 is maintained in a fixed position by the annular edge 4 of the supporting body 2 which pushes it against the upper edge Cs of the neck of the container C, more preferably against the sealing gasket 61, as shown in FIG. 14B. In this way, also the lower element 10 is maintained in a fixed and safe position.

The lower element 10 comprises also a centre hole 13 through which a lower part 21 of the intermediate element 20 is introduced, as described in greater detail below.

The lower element 10 furthermore comprises a second edge 14, or sealing edge or venting edge, which extends upwards from the main body 11 in a direction substantially parallel to the main axis X.

Figure 10B:
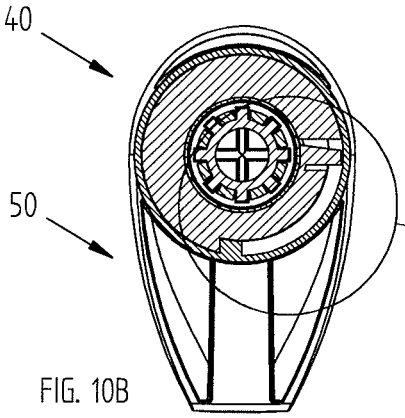
FIG. 10B shows the sectional view according to line X-X of FIG. 10A.
Figure 10C:
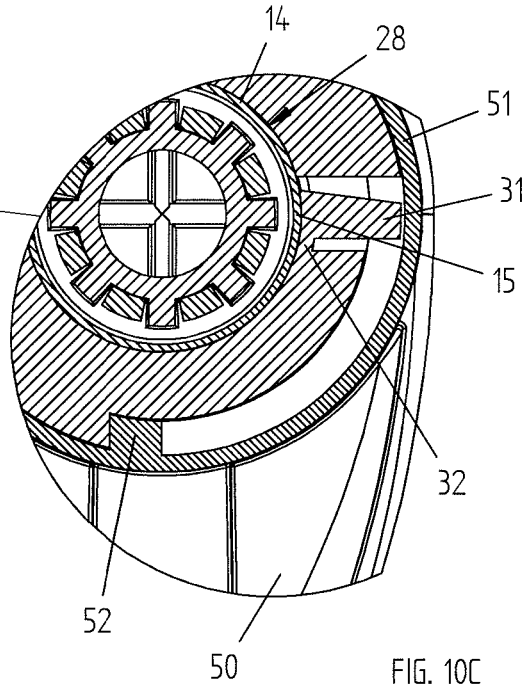
FIG. 10C shows an enlarged detail of FIG. 10B.
Figure 11B:
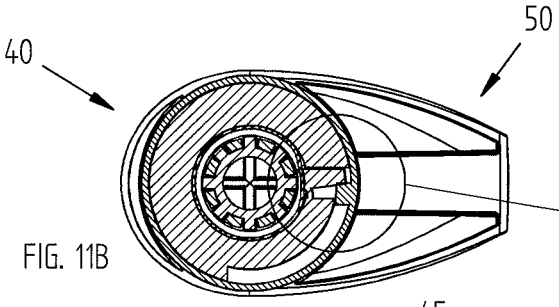
FIG. 11B shows the sectional view according to line XI-XI of FIG. 11A.
Figure 11C:
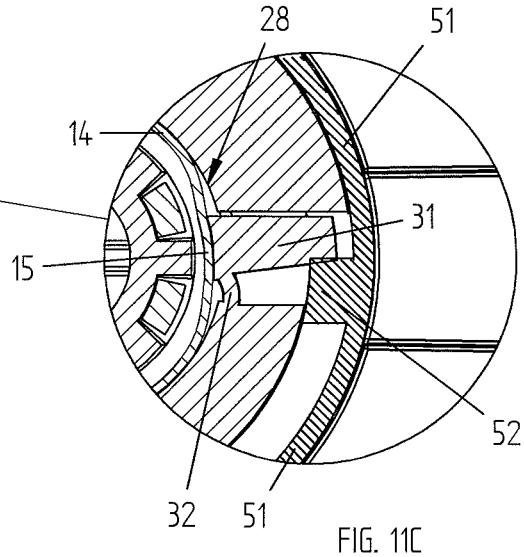
FIG. 11C shows an enlarged detail of FIG. 11B.

According to an aspect of the present invention, the second edge 14 develops according to a preferably circular shape around said main axis X and it is at least partly provided with a flexible portion 15 suited to be deformed and to assume at least two operating positions: a first operating position, in which the flexible portion 15 is at rest (for example, as shown in FIG. 10C), and a second operating position, in which the flexible portion 15 is deformed (for example, as shown in FIG. 11C).

The first and the second operating positions of the flexible portion 15 respectively correspond to the locked configuration and to the configuration of use of the dispensing device 1, always achieved through the rotation of the upper element 40 with respect to the intermediate element 20.

Preferably, the entire second edge 14 is flexible.

The intermediate element 20, too, develops according to a preferably circular shape around the main axis X. The intermediate element 20 comprises said lower portion 21 that is introduced in the centre hole 13 of the lower element 10.

The lower portion 21 of the intermediate element 20 has a preferably hollow cylindrical shape and is suited to be connected to a thin suction tube 27 that sucks the fluid L. The thin suction tube 27 preferably sucks the fluid L from a position near the bottom of the container C, with the system 1 in the operating configuration. The thin tube 27 is preferably coupled with the lower portion 21 of the intermediate element 20 through mechanical interference.

In variant embodiments, the coupling may be obtained in a different way, for example through a glueing operation.

According to the example of embodiment shown in the figures, the intermediate element 20 is connected to the lower element 10 through a snap-on connection obtained by means of an annular projection 16 belonging to the main body 11 of the lower element 10, which projects centrally towards the centre hole 13 and is housed in a corresponding annular cavity 22 belonging to the lower portion 21 of the intermediate body 20 (visible in FIG. 14B).

In a variant embodiment of the invention, the intermediate element 20 and the lower element 10 can be connected through different connection means, for example through a thermoplastic co-moulding process.

The lower portion 21 of the intermediate element 20 is internally provided with valve means 25 suited to regulate the flow of the fluid L coming from the container C.

Said valve means 25 preferably comprise a ball 26 whose diameter is larger than the inner diameter of the thin suction tube 27. The ball 26 can be arranged in different positions in order to allow the thin suction tube 27 to be selectively opened and closed during the operation of the device 1, as illustrated in greater detail further on in the description.

Figure 7A:
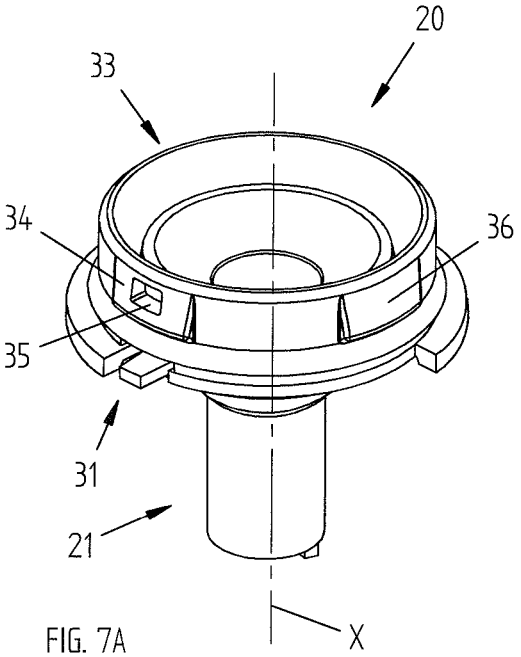
FIG. 7A shows an axonometric view of an element of FIG. 5.
Figure 7B:
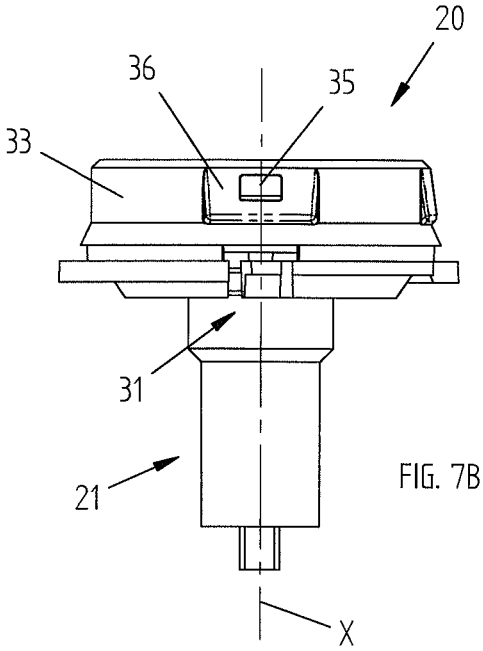
FIG. 7B shows a side view of the element of FIG. 7A.
Figure 7C:
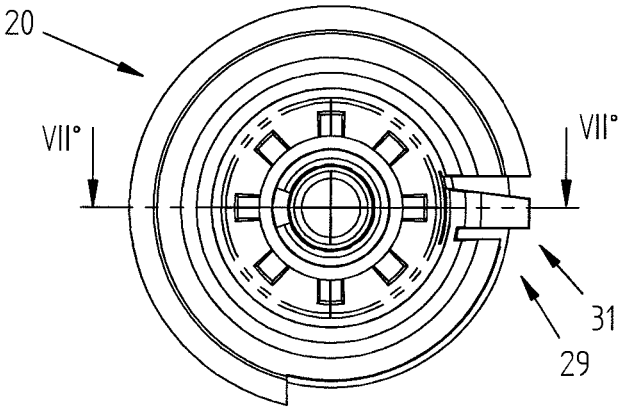
FIG. 7C shows a bottom plan view of the element of FIG. 7A.
Figure 7D:
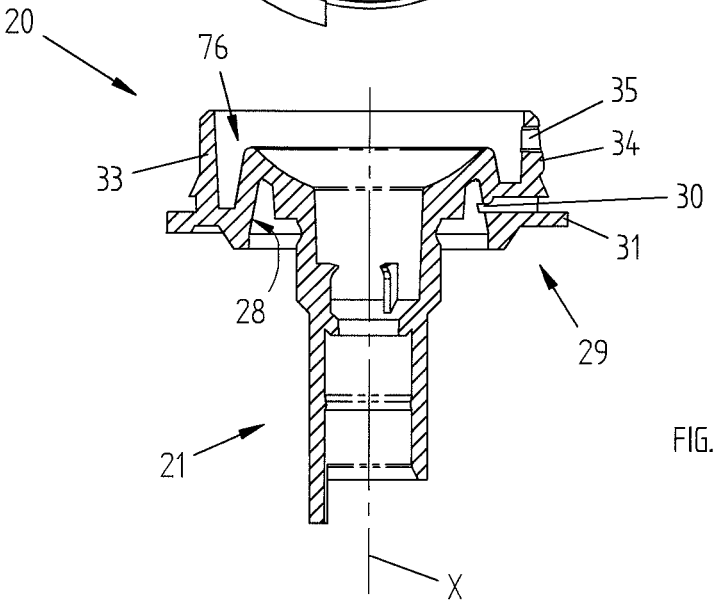
FIG. 7D shows the sectional view according to line VII-VII of FIG. 7C.

The intermediate element 20 comprises also a shaped area 76 suited to receive the second edge 14 of the lower body 10 (as shown in FIG. 7D).

In particular, the shaped area 76 preferably comprises an annular surface 28 that extends circumferentially around said main axis X. The annular surface 28 is such that the second edge 14 of the lower body 10 abuts it.

The annular surface 28 has an area of discontinuity 29 in which a passage 30 (better visible in FIG. 7D) is defined. This area 29 is associated with a counteracting element 31, or tooth, which is connected to the annular surface 28 through an elastically yielding portion 32 (FIGS. 10C and 11C).

In the locked configuration of the dispensing system 1, the tooth 31 is in a released, non-compressed position, as shown in FIG. 10C. In this condition, the entire annular surface 28 is arranged so that the second edge 14 of the lower body 11 abuts it and the second edge 14 closes the passage 30.

In the configuration of use of the dispensing system 1, the tooth 31 is in a compressed position, as shown in FIG. 11C. In this condition, the tooth 31 pushes the flexible portion 15 of the second edge 14 towards the centre, thus opening the passage 30.

The opening of the passage 30 allows the creation of a passage for the refilling air during the venting step, as described in greater detail below.

The intermediate element 20 furthermore comprises an upper neck 33 that extends circumferentially around said main axis X. A first projecting portion 34 and a second projecting portion 36 are defined on the upper neck 33, as shown in FIG. 7A. A passage hole 35 is defined at the level of the first projecting portion 34.

In the embodiment illustrated herein, the two projecting portions 34, 36 are preferably arranged so that they are angularly spaced by 90° with respect to each other. Said angle substantially corresponds to the rotation angle of the third upper element 40 with respect to the intermediate element 20 when it is arranged between the two operating positions described above. In variant embodiments, a different angle can be selected.

The upper element 40 is coupled with the top of the intermediate element 20 and, as explained above, it can be rotated with respect to the latter between two operating positions, preferably at 90° from each other.

In the embodiment illustrated herein, the upper element 40 is made in two parts 45 and 50, which are conveniently coupled with each other. In variant embodiments, it may be constituted by a single element.

Said parts 45 and 50 respectively define an actuator element 45 and a dispensing nozzle 50.

The actuator element 45 has a preferably hemispherical shape 4. The actuator element 45 is elastically yielding and therefore deformable, as shown for example in FIG. 16.

In variant embodiments, the actuator element can have a different shape, provided that it is suited to be deformed and then to substantially recover its initial shape.

The actuator element 45 is provided with a lower annular edge 46 arranged so that it abuts the outside of the upper neck 33 of the intermediate element 20.

The actuator element 45, together with the intermediate element 20, defines a collapsible chamber 60 suited to receive a given quantity of fluid L to be dispensed.

For this purpose, said valve means 25 (ball 26) are arranged between the chamber 60 and the thin suction tube 27 and therefore regulate the flow of the fluid L from the container C towards the chamber 60.

The dispensing nozzle 50 is connected to the lower part of the actuator element 45, in particular at the level of the lower annular edge 46 of the actuator element 45.

The dispensing nozzle 50 comprises an annular portion 51 that surrounds the actuator element 45 and a duct 63 that extends between an inner end 63*a* and an outer end 63*b* for dispensing the fluid L towards the outside of the device 1, and thus towards the outside of the container C.

Figure 12B:
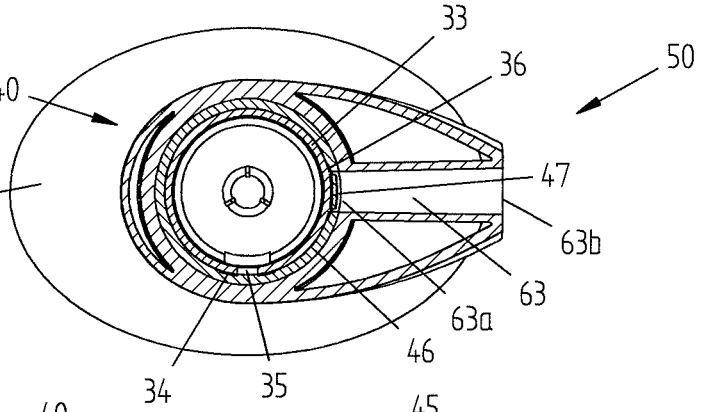
FIG. 12B shows the sectional view according to line XII-XII of FIG. 12A.
Figure 12A:
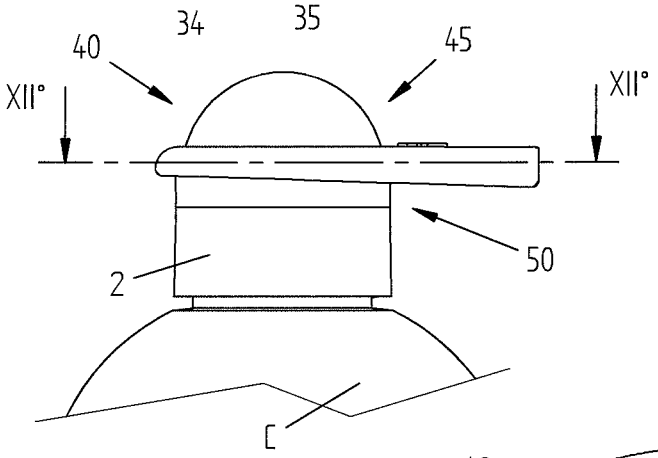
FIG. 12A shows a partial front view of the system of FIG. 1 in the first locked configuration.

In the locked configuration of the dispensing device 1, the inner end 63*a* of the duct 63 is aligned with the second projecting portion 36 of the intermediate element 20, which prevents the passage of fluid from the chamber 60 to the duct 63 itself, as shown in FIG. 12B.

Figure 13B:
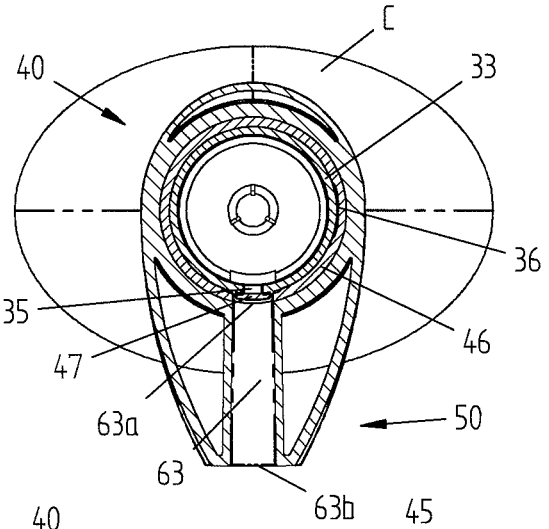
FIG. 13B shows the sectional view according to line XIII-XIII of FIG. 13A.
Figure 13A:
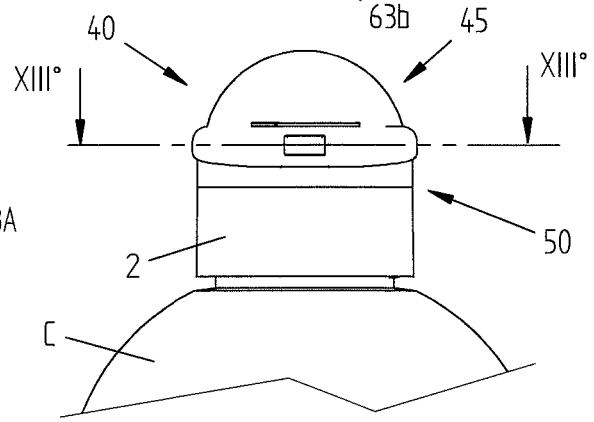
FIG. 13A shows a partial front view of the system of FIG. 3 in the dispensing configuration.

In the configuration of use of the dispensing device 1, the inner end 63*a* of the duct 63 is aligned with the first projecting portion 34 and with the respective passage hole 35 of the intermediate element 20, as shown in FIG. 13B.

The annular portion 51 of the dispensing nozzle 50 furthermore comprises a reference element 52, or projection, suited to cooperate with the tooth 31 of the intermediate element 20. In the locked configuration, the projection 52 does not cooperate with the tooth 31 (FIG. 10C), while in the configuration of use, when the upper element 40 is rotated, the projection 52 cooperates with the tooth 31 so as to move it to the compressed position, as previously described, in which the passage 30 is opened so as to allow air refilling during the venting step (FIG. 11C).

According to an aspect of the present invention, the actuator element 45, and more preferably its lower annular edge 46, comprises a movable element 47 arranged at the level of the inner end 63*a* of the duct 63.

Figure 9B:
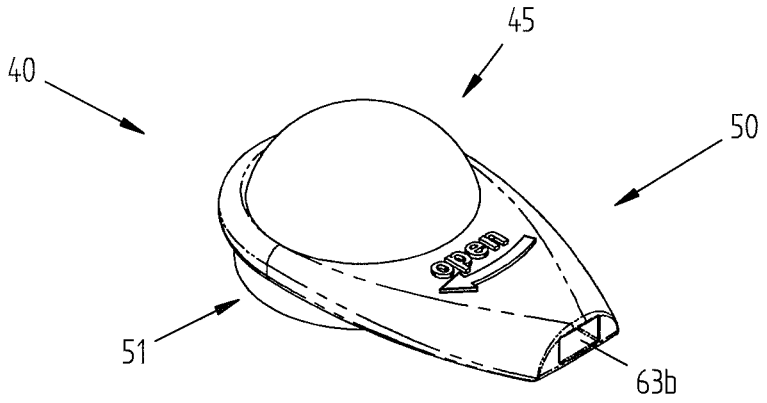
FIG. 9B shows an axonometric view of the two elements of FIG. 9A assembled together.
Figure 9C:
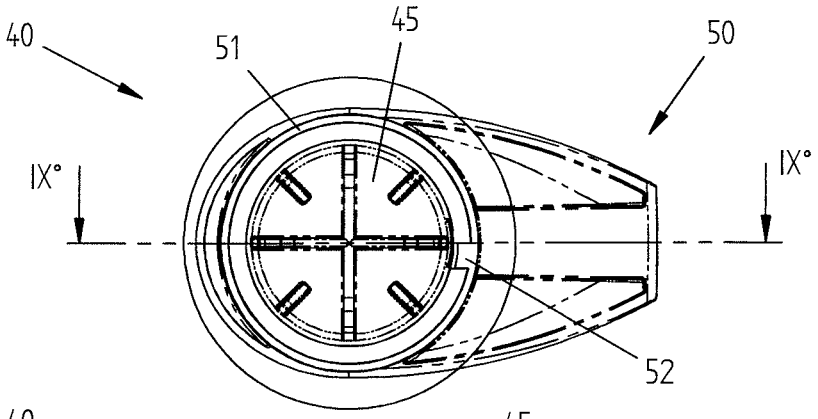
FIG. 9C shows a bottom plan view of the elements of FIG. 9B.
Figure 9D:
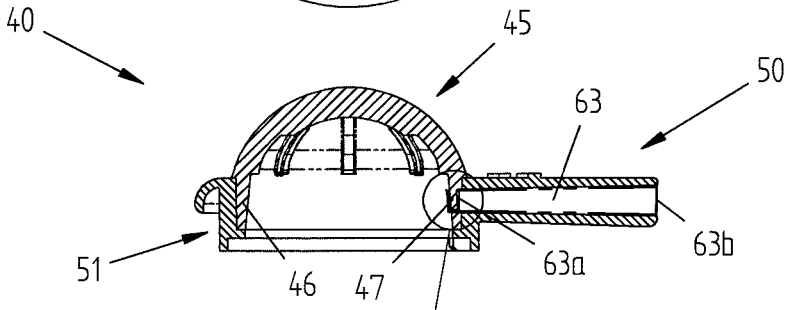
FIG. 9D shows the sectional view according to line IX-IX of FIG. 9C.
Figure 9E:
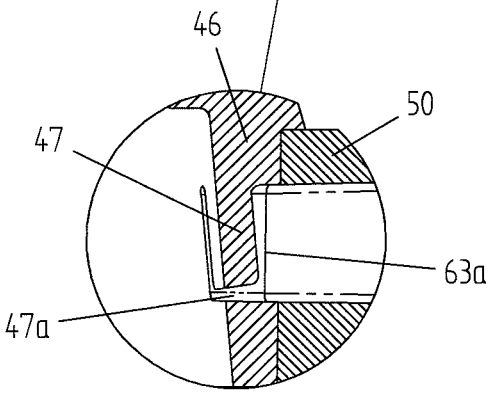
FIG. 9E shows an enlarged detail of FIG. 9D.

The movable element 47 is preferably obtained on the portion of the lower annular edge 46, through a peripheral slot 47*a* that substantially defines a window (visible for example in FIG. 9A).

Furthermore, in the configuration of use of the dispensing device 1, said movable element 47 comes to be positioned also at the level of the passage hole 35 of the first projecting portion 34 of the intermediate element 20.

The movable element 47 is thus part of valve means 48 suited to control the passage of the fluid L from the inside of the chamber 60 towards the duct 63 and then towards the outside.

The configurations of the dispensing device 1 of the invention are illustrated and described here below with reference to Figures from 10A to 11C.

Figure 10A:
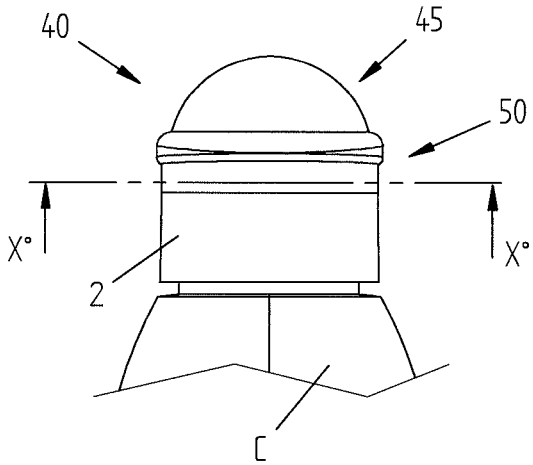
FIG. 10A shows a partial side view of the system of FIG. 1 in the first locked configuration.

The device 1 is shown in FIGS. 10A-10C in its locked configuration, as already mentioned above.

The upper element 40 is arranged in the first operating position with respect to the intermediate element 20. In said operating position, in particular, the projection 52 is located at 90° with respect to the tooth 31 of the intermediate element 20 and does not interfere with it.

In this condition, the second edge 14 of the lower element 10 abuts completely and circumferentially the surface 28 of the intermediate element 20 and therefore the passage 30 for the refilling air for the venting step is closed.

Figure 11A:
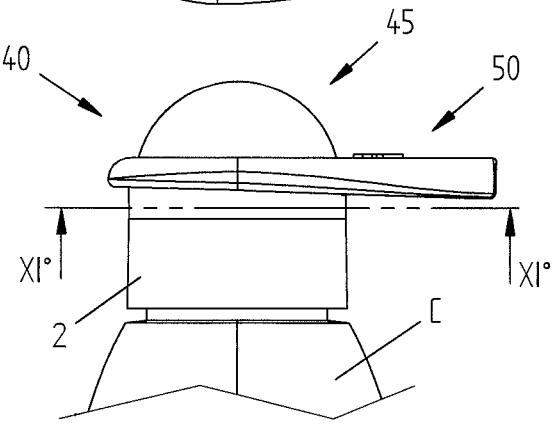
FIG. 11A shows a partial side view of the system of FIG. 3 in the dispensing configuration.

From this operating position, following the rotation of the upper element 40 by 90° with respect to the intermediate element 20 (FIGS. 11A-11C) the projection 52 comes into contact with and compresses the tooth 31 towards the main axis X, internally pushing the flexible portion 15 of the second edge 14. Pushing the flexible portion 15 of the second edge 14 towards the inside locally moves the edge 14 itself away from the surface 28 of the intermediate element 20, thus opening the passage 30 for conveying the refilling air during the venting step.

The operating steps of the device 1 of the invention in the configuration of use, as illustrated above, are described here below with reference to Figures from 15A to 17.

Figure 15B:
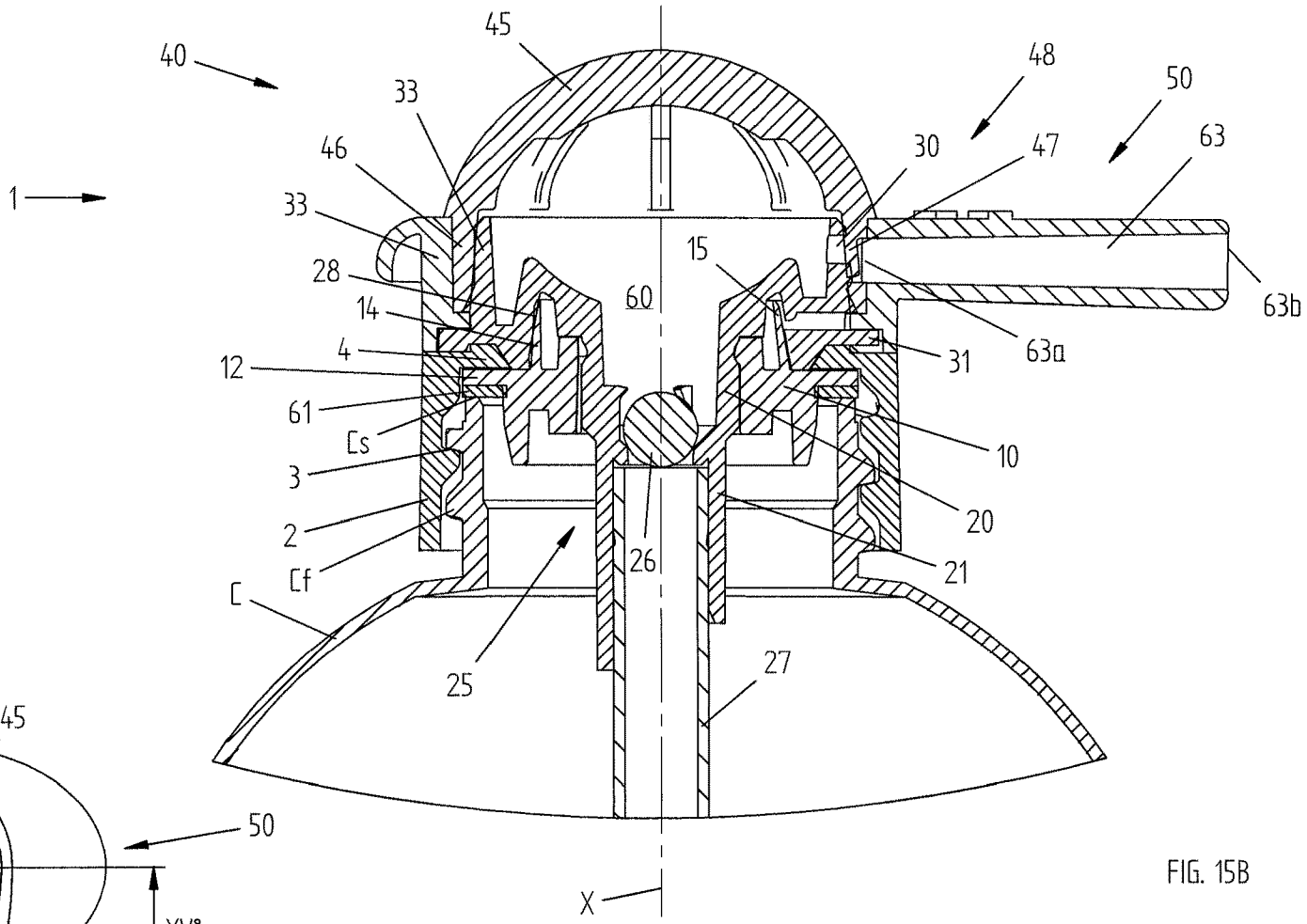
FIG. 15B shows the partial sectional view according to line XV-XV of FIG. 15A.
Figure 15A:
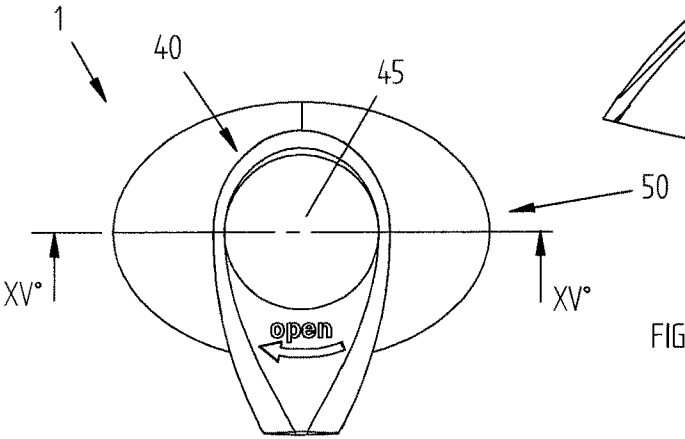
FIG. 15A shows a top plan view of the system of FIG. 3 in the dispensing configuration.

In FIG. 15B the device 1 is in the configuration in which it is ready for use.

The description of the steps starts from the configuration of use of FIG. 15B, in which it is assumed that the fluid L is already present inside the chamber 60, since this is the operating condition that occurs during normal use of the device 1, except when it is used for the first time. In FIG. 15B it can be noted, in particular, that the flexible portion 15 of the second edge 14 is pushed towards the inside of the projection 31.

Figure 16:
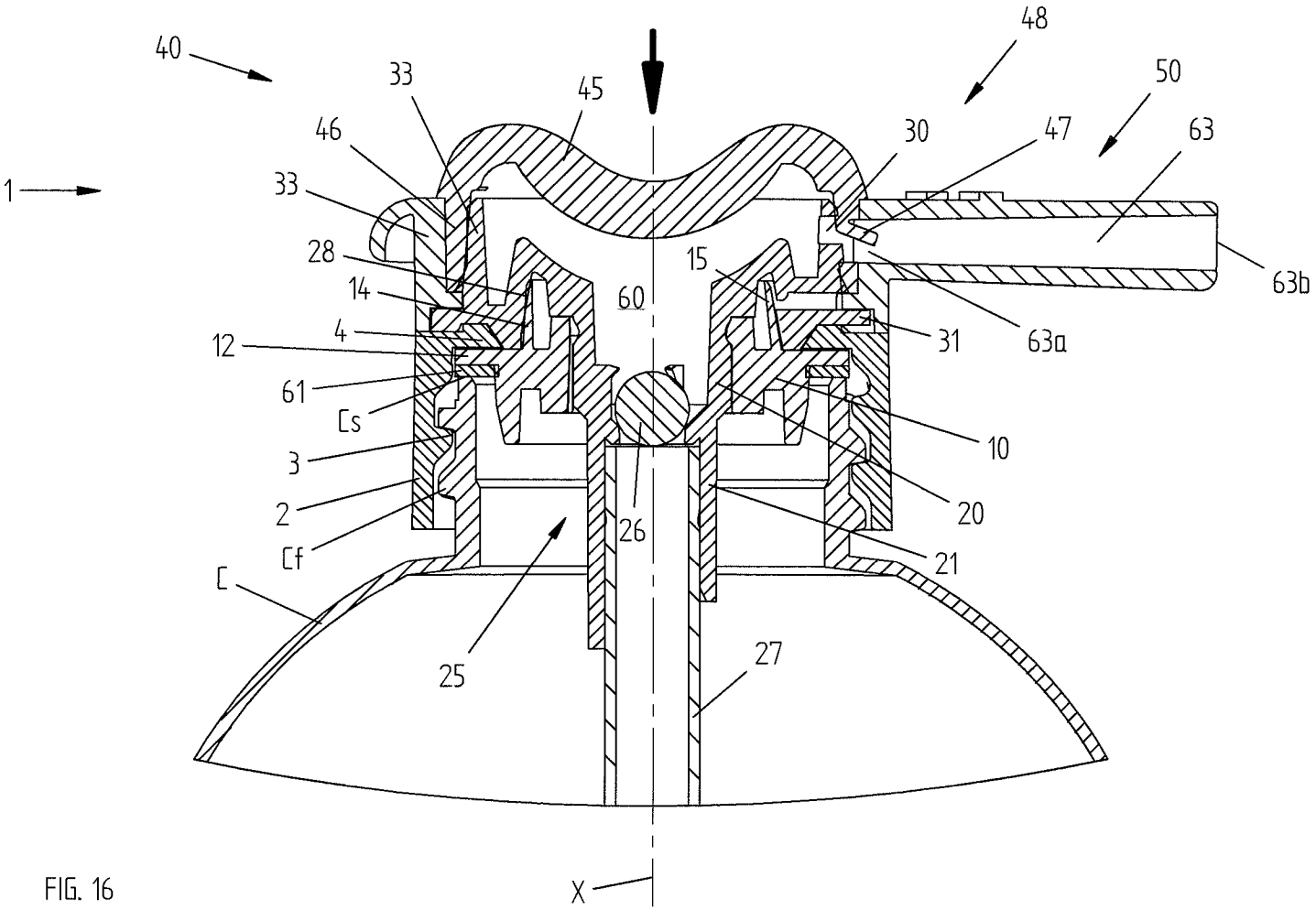
FIG. 16 shows the system of FIG. 15B during the operating step intended to dispense the fluid.

FIG. 16 shows an operating step of the device 1, in which the actuator element 45 is compressed by the user, preferably with his/her fingers or with suitable actuating means.

The pushing action exerted on the actuator element 45 increases the pressure inside the chamber 60 and, on the one hand, the ball 26 is maintained in the closed position while, on the other hand, the flexible element 47 bends and is subjected to a lateral deformation towards the outside, opening the passage towards the duct 63. The fluid L thus passes through the passage hole 35 and the duct 63 and then flows towards the outside.

At the end of the compression step, a predetermined quantity of fluid L will have been dispensed from the chamber 60 towards the outside.

After the dispensing step, during which the fluid L is dispensed, the successive step starts, during which the actuator element 45 is released and which coincides with the step in which the fluid L is sucked from the container C in order to refill the correct quantity of fluid L inside the chamber 60, so that said fluid L can be used for the successive dispensing cycle, and with the venting step, meaning the step in which the container C is refilled with a given quantity of air that serves to compensate for the previously dispensed volume of fluid L.

At the beginning of the release step, the flexible element 47 returns to abut the outside of the dispensing hole 35 and therefore the chamber 60 is sealed with respect to the outside.

At the same time, the ball 26, due to the effect of decompression in the chamber 60, is sucked towards the inside of the chamber 60, opening the thin suction tube 27 at the top.

The actuator element 45 is automatically decompressed thanks to its intrinsic elastic yielding properties and the fluid L is sucked from the inside of the container C along the thin suction tube 27 towards the inside of the chamber 60.

Once the suction step has been completed, the ball 26 comes to be positioned again so that it obstructs the thin suction tube 27 and the device 1 returns to the initial condition, that is, the condition shown in FIG. 15B, with the chamber 60 filled with a dose of fluid L that can be used for the successive dispensing cycle.

At the same time, during the release step, while the fluid L is sucked from the inside of the container C along the thin suction tube 27 towards the inside of the chamber 60, a portion of air is sucked into the container C through the passage 30.

Figure 17:
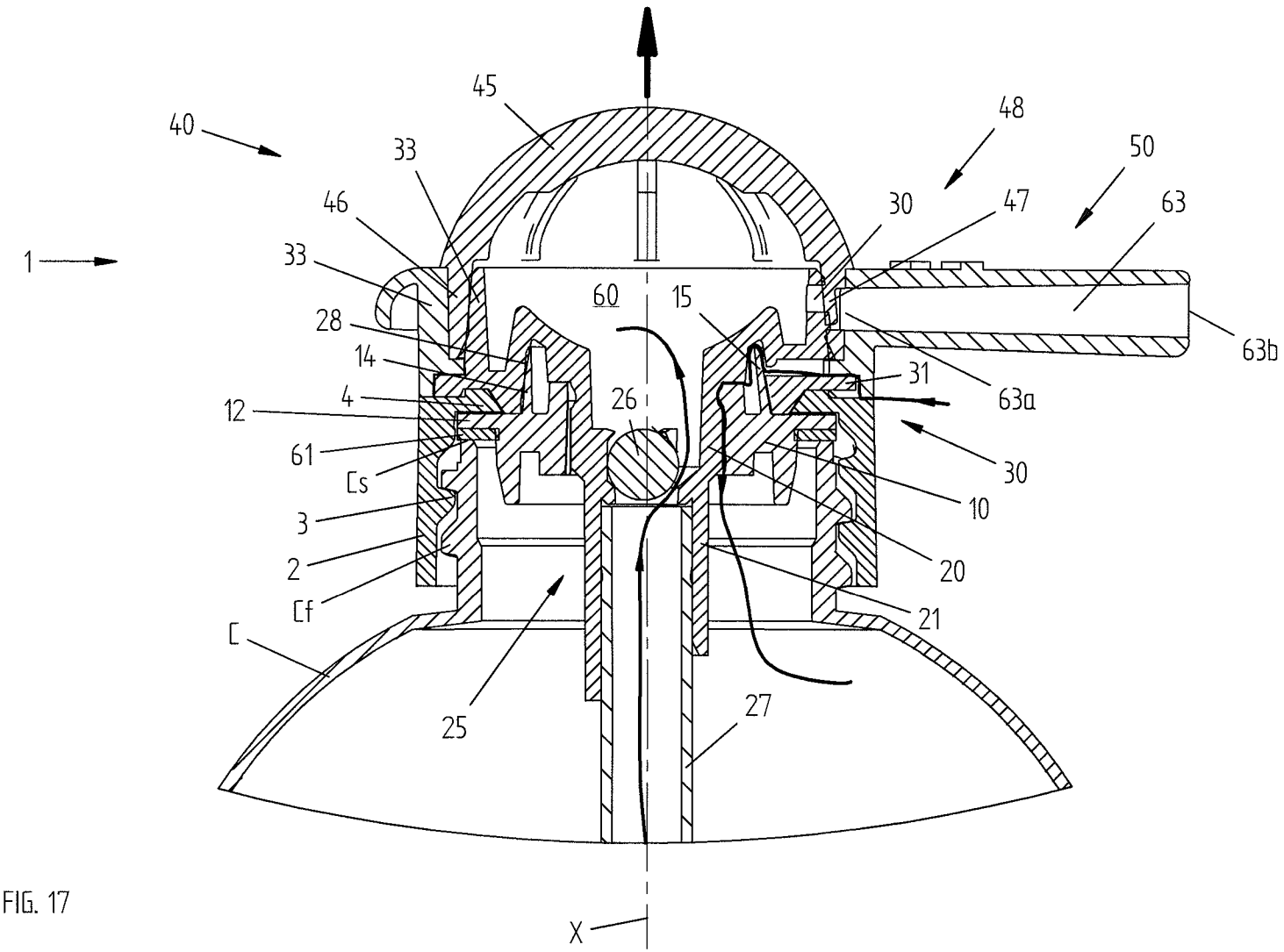
FIG. 17 shows the system of FIG. 16 during the release step after the dispensing operation.

In particular, as shown in FIG. 17, the air reaches the inside of the container C flowing through the passage 30 and the gaps defined among the various elements that make up the dispensing device 1. In variant embodiments, the passage of air may be favoured through the creation of apposite passage channels obtained in one or more of the elements that make up the dispensing device 1.

According to the above, it can be understood that the dispensing device that is the subject of the invention has a simplified structure with a reduced number of elements compared to the devices of the known type, with consequently reduced production times and/or costs.

The reduced number of elements makes it possible to achieve higher reliability and efficiency compared to the devices of the known type.

The reduced number of elements, furthermore, makes it possible to manufacture a dispensing device with reduced overall dimensions and reduced weight compared to the devices of the known type.

It has thus been shown that the present invention allows the set objects to be achieved. In particular, it makes it possible to manufacture a device for dispensing fluids which allows a simplified structure to be obtained compared to the devices of the known type.

While the present invention has been described with reference to the particular embodiment shown in the figures, it should be noted that the present invention is not limited to the specific embodiment illustrated and described herein; on the contrary, further variants of the embodiment described herein fall within the scope of the present invention, scope which is defined in the claims.

The invention claimed is:

1. A device for dispensing a fluid, comprising a supporting structure provided with a coupling element for coupling the supporting structure with a container that holds said fluid and:

an outlet duct for said fluid;

at least one collapsible chamber suited to receive a given quantity of said fluid;

a first valve capable of controlling the passage of said fluid from the inside of said container towards said chamber; and an air refilling valve capable of controlling the passage of a given quantity of air from the outside of said container towards the inside of said container, wherein said air refilling valve comprises at least one flexible portion of an edge belonging to a first element of said device associated with said supporting structure, said flexible portion being capable of assuming a closed position in order to avoid the passage of air from the outside of said container towards the inside of said container and capable of assuming an open position in order to allow the passage of said quantity of air from the outside of said container towards the inside of said container;

wherein the device further comprises a second element associated with said first element, said second element comprising a counteracting element capable of pushing said flexible portion in order to move said flexible portion from said closed position to said open position; and wherein said second element comprises a surface arranged so that said edge abuts the surface completely in said closed position.

2. The device according to claim 1, wherein said counteracting element is capable of assuming a first rest position in which said counteracting element does not counteract said flexible portion in said closed position and an operating position in which said counteracting element pushes said flexible portion and places said flexible portion in said open position.

3. The device according to claim 1, wherein the device further comprises a third element associated with said second element, said third element comprising a reference element capable of cooperating with said counteracting element in order to move said counteracting element between said first rest position and said operating position.

4. The device according to claim 3, wherein said third element is movable with respect to said second element in such a way that said third element can be positioned in a first position, in which said reference element does not cooperate with said counteracting element, and in a second position, in which said reference element cooperates with said counteracting element in order to place the counteracting element in said operating position.

5. The device according to claim 4, wherein said third element is capable of rotation with respect to said second element between said first position and said second position.

6. The device according to claim 1, wherein said edge is an annular edge that develops around a main axis.

7. The device according to claim 1, wherein said chamber is at least partially defined by an elastically yielding portion associated with said supporting structure.

8. The device according to claim 3, wherein said chamber is at least partially defined by an elastically yielding portion of said third element.

9. The device according to claim 3, wherein said outlet duct is created in said third element.

10. The device according to claim 3, wherein the device further comprises a second valve capable of controlling the passage of said fluid from said chamber towards said outlet duct.

11. The device according to claim 10, wherein said second valve comprises a movable element belonging to said third element.

12. The device according to claim 1, wherein the device further comprises a thin suction tube suited to convey said fluid from said container to said chamber.

13. A system for dispensing a fluid comprising a container for said fluid and a device for dispensing said fluid according to claim 1, said device being applied to said container.

* * * * *